US007726462B2

(12) United States Patent
Baldanza et al.

(10) Patent No.: US 7,726,462 B2
(45) Date of Patent: Jun. 1, 2010

(54) METHOD AND UNIT FOR THE FORMATION OF GROUPS OF PRODUCTS IN A MACHINE FOR CONTINUOUS PACKAGING OF PRODUCTS

(75) Inventors: Nicola Baldanza, Casalecchio Di Reno (IT); Moreno Cremonini, Castello Serravalle (IT); Giordano Gorrieri, Pianoro (IT)

(73) Assignee: KPL Packaging S.p.A. Societa Unipersonale, Calderara Di Reno (IT)

( * ) Notice: Subject to any disclaimer, the term of this patent is extended or adjusted under 35 U.S.C. 154(b) by 447 days.

(21) Appl. No.: 11/291,685

(22) Filed: Dec. 1, 2005

(65) Prior Publication Data

US 2006/0144674 A1 Jul. 6, 2006

(30) Foreign Application Priority Data

Dec. 1, 2004 (EP) ..... 04425906

(51) Int. Cl.
*B65B 25/14* (2006.01)
*B65G 37/00* (2006.01)

(52) U.S. Cl. ..... 198/418.7; 198/459.1; 198/418; 198/434; 198/431; 53/550; 53/371.6; 53/374.6

(58) Field of Classification Search ..... 198/418, 198/418.7, 434, 459.1
See application file for complete search history.

(56) References Cited

U.S. PATENT DOCUMENTS

| | | | | |
|---|---|---|---|---|
| 2,748,550 | A * | 6/1956 | Soldner | 53/498 |
| 3,512,625 | A * | 5/1970 | Burgess et al. | 198/418.7 |
| 4,262,792 | A * | 4/1981 | Davies | 198/348 |
| 4,279,557 | A * | 7/1981 | Stodt et al. | 414/400 |
| 5,020,655 | A | 6/1991 | Cruver | |
| 5,251,740 | A * | 10/1993 | Spatafora et al. | 198/458 |
| 5,255,495 | A | 10/1993 | Kovacs | |
| 5,893,701 | A * | 4/1999 | Pruett | 414/798.2 |
| 6,793,065 | B2 * | 9/2004 | Ziegler | 198/575 |

OTHER PUBLICATIONS

European Search Report dated Apr. 27, 2005.

* cited by examiner

*Primary Examiner*—Gene Crawford
*Assistant Examiner*—Kavel P Singh
(74) *Attorney, Agent, or Firm*—McCarter & English, LLP

(57) ABSTRACT

Described herein is a method and a unit for the formation of groups of products in a machine for continuous packaging of products, according to which at least two continuous rows of products are fed via two conveyor devices set in series with respect to one another along a first given path and in contact with at least one alignment element, which is set transverse to the first path and in front of the rows of products to align the rows themselves with respect to one another, and is displaced along a second, loop-like, path defined by two portions, along which the alignment element is set on the inside and on the outside, respectively, of the first path.

46 Claims, 4 Drawing Sheets

METHOD AND UNIT FOR THE FORMATION OF GROUPS OF PRODUCTS IN A MACHINE FOR CONTINUOUS PACKAGING OF PRODUCTS

The present invention relates to a method for the formation of groups of products in a machine for continuous packaging of products.

BACKGROUND OF THE INVENTION

Machines for packaging of products currently on the market normally comprise one first conveyor device and one second conveyor device, which are set in series with respect to one another, are connected to one another in a position corresponding to a transfer station, and are designed to feed at least two continuous rows of products set alongside one another along a given path and in a given direction.

The rows of products are fed by the conveyor devices in contact with an alignment element set transverse to the aforesaid path and at a distance from the transfer station which is such as to enable each time transfer on the second conveyor device of a number of products equal to the number of products of a group.

Once the rows of products are set in contact with the alignment element, the first conveyor device is deactivated, and the alignment element is displaced, normally via at least one actuator cylinder, transverse to, and on the outside of, the aforesaid path to enable the second conveyor device to separate a group of products from the rows themselves.

Known packaging machines of the type described above present some drawbacks mainly deriving from the fact that said machines have a relatively low productivity on account of the dead times introduced by the displacements of the alignment element under the thrust of the aforesaid actuator cylinder.

SUMMARY OF THE INVENTION

The purpose of the present invention is to provide a method for the formation of groups of products in a machine for continuous packaging of products which will be free from the drawbacks set forth above.

According to the present invention, a method for the formation of groups of products in a machine for continuous packaging of products is provided as claimed in the attached Claims.

The present invention further relates to a unit for the formation of groups of products in a machine for continuous packaging of products.

According to the present invention, a unit for the formation of groups of products in a machine for continuous packaging of products is provided as claimed in the attached Claims.

BRIEF DESCRIPTION OF THE DRAWINGS

The present invention will now be described with reference to the annexed plate of drawings, which illustrate a non-limiting example of embodiment thereof, and in which.

DETAILED DESCRIPTION OF THE INVENTION

Figure 1:
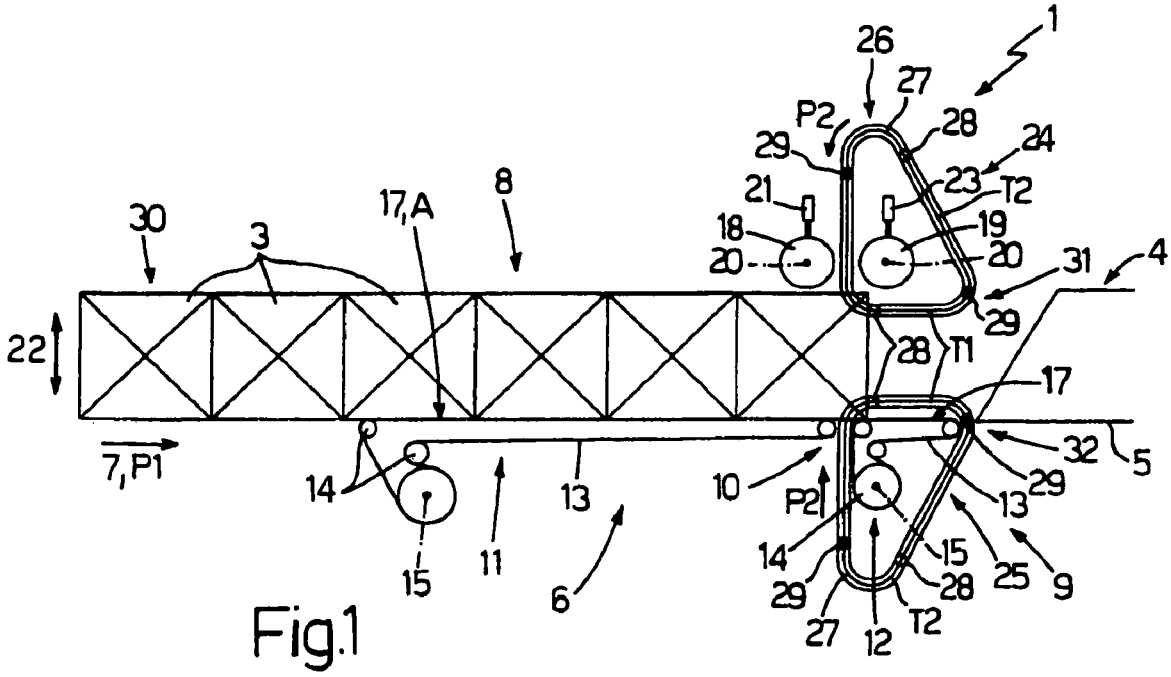
FIGS. 1 to 6 are schematic side views of a preferred embodiment of the unit of the present invention illustrated in six different operating positions.

With reference to the attached figures, the reference number 1 designates, as a whole, a unit for the formation of groups

2 (FIGS. 4, 5, and 6) of products 3 in a machine for continuous packaging of products 3, further provided with a wrapping unit 4 comprising a forming device 5, inside which a tubular casing (not illustrated) of wrapping material is formed, which is designed to receive in succession the groups 2 from the unit 1, and which is fed at a substantially constant rate along the device 5.

In the ensuing treatment, the products 3 considered are packs of rolls of paper, each of which consists of at least one roll of paper wrapped in a corresponding sheet of wrapping, to which the present description will make explicit reference without this however implying any loss in generality.

The unit 1 comprises a line 6 of advance, which extends along a given path P and in a substantially horizontal direction 7 and is defined by two conveyor devices 8, 9, which are set in series with respect to one another and are connected to one another in a position corresponding to a transfer station 10.

Figure 7:
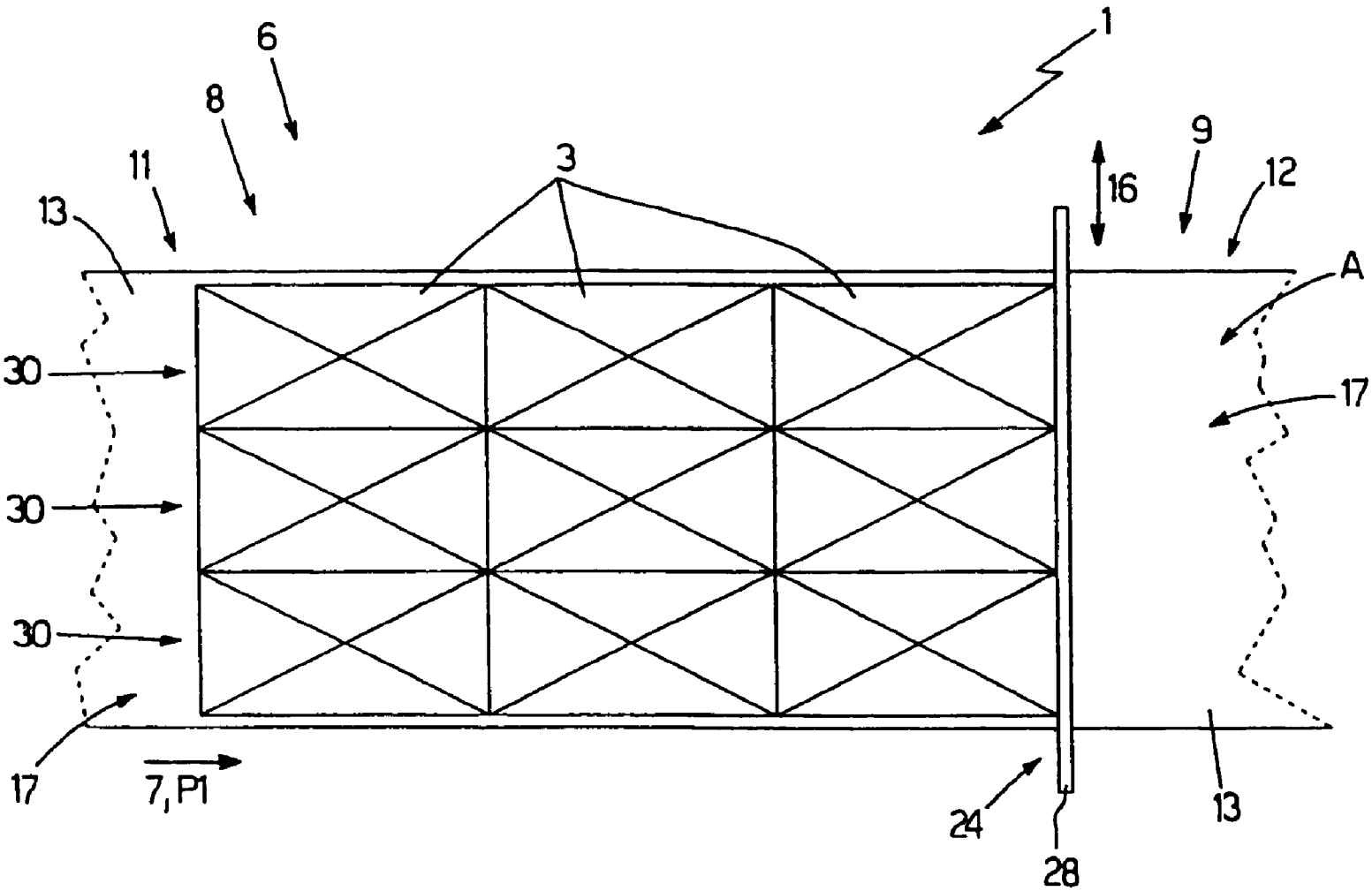
FIG. 7 is a schematic plan view of the unit of FIG. 1.

Each device 8, 9 comprises a respective bottom conveyor 11, 12, in turn comprising at least one belt 13 looped around a plurality of pulleys 14, one of which is motor-driven via an actuation device (of a known type and not illustrated), mounted so as to rotate about respective axes 15 of rotation substantially parallel to one another and to a horizontal direction 16 (FIG. 7) transverse to the direction 7. Each belt 13 has a top conveying branch 17 substantially coplanar with the branch 17 of the other belt 13 so as to define a resting surface A for the products 3.

Each device 8, 9 further comprises a respective top roller 18, 19 of advance, which extends in the direction 16, is set on the opposite side of the corresponding conveyor 11, 12 with respect to the products 3, and is mounted so as to rotate, under the thrust of an actuation device (of a known type and not illustrated), about an axis 20 substantially parallel to the axes 15.

In connection with what has been set forth above, it should be pointed out that the conveyor 12 and the roller 19 of the conveyor device 9 are displaced in a continuous way with the same law of motion as that of the aforesaid tubular casing (not illustrated) and that the conveyor 11 and the roller 18 of the conveyor device 8 are displaced with respective laws of motion independent of one another, which are controlled selectively by an electronic control unit (not illustrated) according to modalities that will be illustrated more clearly in what follows.

The roller 18 is set upstream of the station 10 in the direction 7, and is mobile, under the thrust of at least one actuator cylinder 21, in a vertical direction 22 orthogonal to the directions 7 and 16 between a raised resting position of disengagement from the products 3 and a lowered operating position of engagement of the products 3 themselves. The roller 19 is set downstream of the station 10 in the direction 7, and is mobile, under the thrust of at least one actuator cylinder 23, in the direction 22 between a raised resting position of disengagement from the products 3 and a lowered operating position of engagement of the products 3 themselves.

The unit 1 further comprises a device 24 for thrust and alignment, which, in turn, comprises a pair of bottom conveyors 25 (just one of which is illustrated in FIGS. 1 to 6) arranged on opposite sides of the conveyor 12 in the direction 16, and a pair of top conveyors 26 (just one of which is illustrated in FIGS. 1 to 6) arranged on opposite sides of the roller 19 in the direction 16.

Each conveyor 25, 26 comprises a chain 27 looped around a corresponding plurality of sprockets (not illustrated), one of which is motor-driven via an actuation device (of a known type and not illustrated) and which are mounted so as to rotate about respective axes of rotation (not illustrated) substantially parallel to one another and to the direction 16.

Each corresponding pair of chains 27 supports, in the case in point, two alignment rods 28, which extend between the corresponding chains 27 in the direction 16, and are uniformly distributed along the corresponding chains 27 themselves, and a pair of thrust rods 29, which extend between the corresponding chains 27 in the direction 16, are uniformly distributed along the corresponding chains 27 themselves, and are alternated to the corresponding rods 28. In particular, the distances of each thrust rod 29 from the corresponding alignment rods 28 are different from one another.

Each rod 28, 29 is fed by the corresponding conveyors 25, 26 in phase with a corresponding rod 28, 29 of the other conveyors 25, 26 and along a loop-like path P2 comprising two portions T1, T2, in a position corresponding to which the rod 28, 29 itself is set on the inside and on the outside, respectively, of the path P1.

Operation of the unit 1 will now be described with reference to FIGS. 1 to 6 and starting from an instant in which, according to what is illustrated in FIG. 1:

- the two rollers 18 and 19 are arranged in their raised resting positions; and
- the conveyors 11 and 12 co-operate with one another for feeding a plurality of continuous rows 30 of products 3 (in the case in point three rows 30) parallel to one another and to the direction 7 along the path P1, through the station 10, and in contact with a pair of alignment rods 28 fed by the corresponding conveyors 25, 26 along the portions T1 of the corresponding paths P2, i.e., inside the path P1.

The rows 30 are fed by the conveyor 11 in the direction 7 at a rate higher than the rate of the conveyor 12, and the rods 28 considered are fed in the direction 7 at a rate lower than the rate of the conveyor 12 so as to enable the rows 30, by combining the rate of the conveyors 11 and 12 and of the rods 28 considered, to be aligned to one another in the direction 16 up against the rods 28 themselves.

Figure 2:
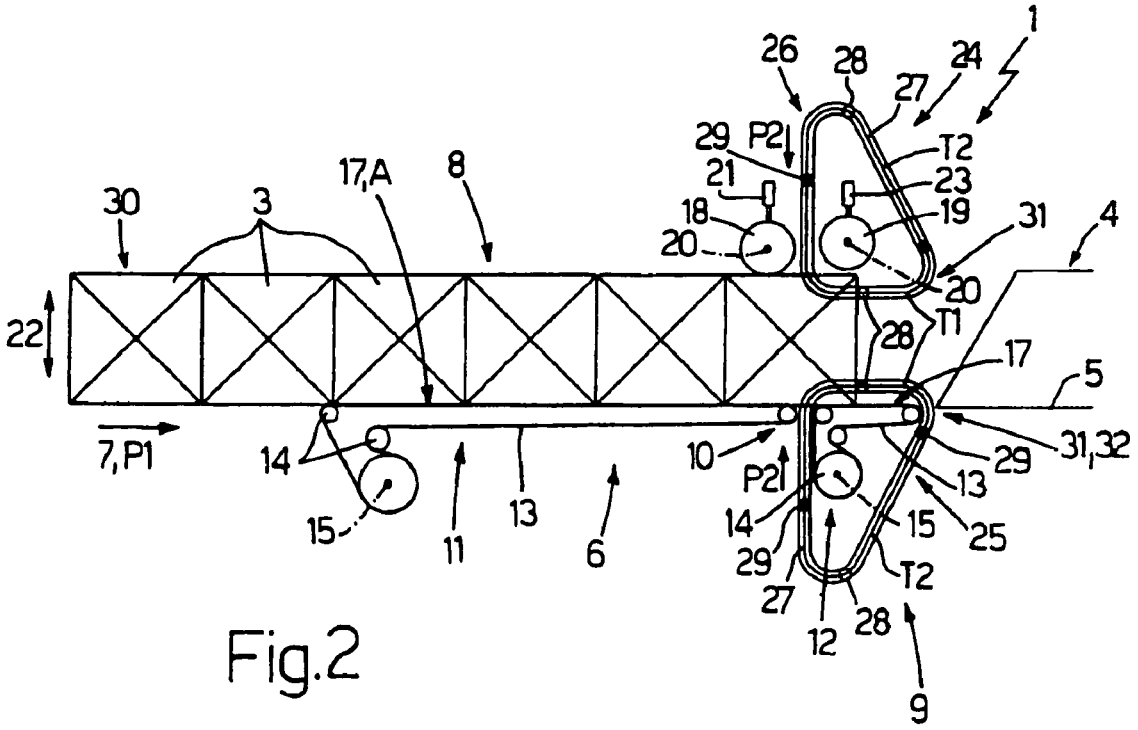
Figure 3:
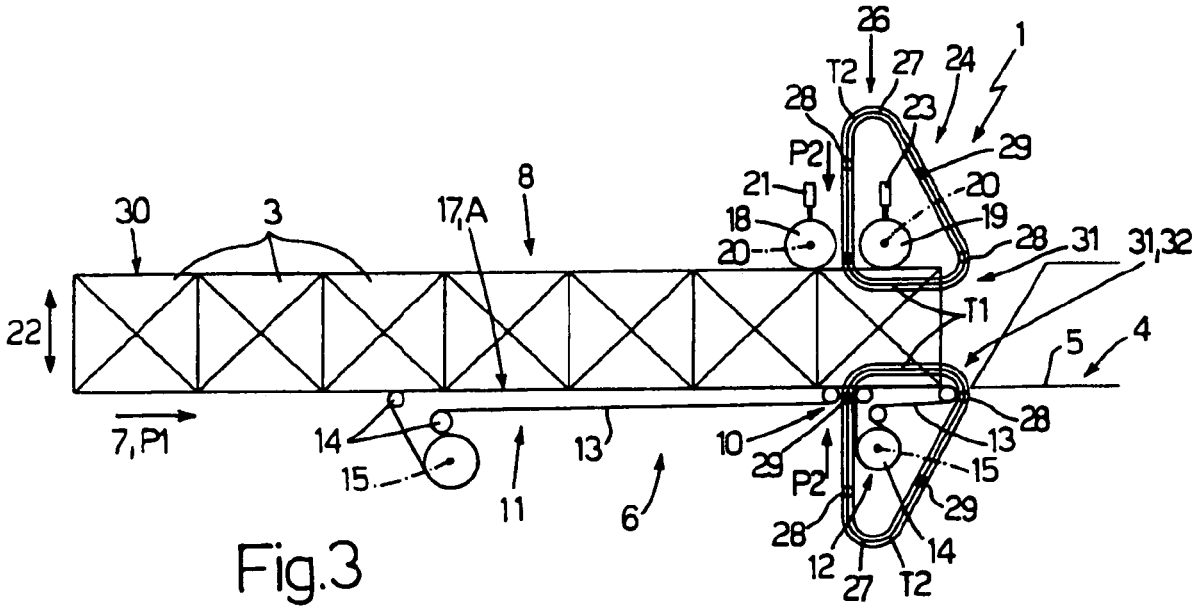
Figure 4:
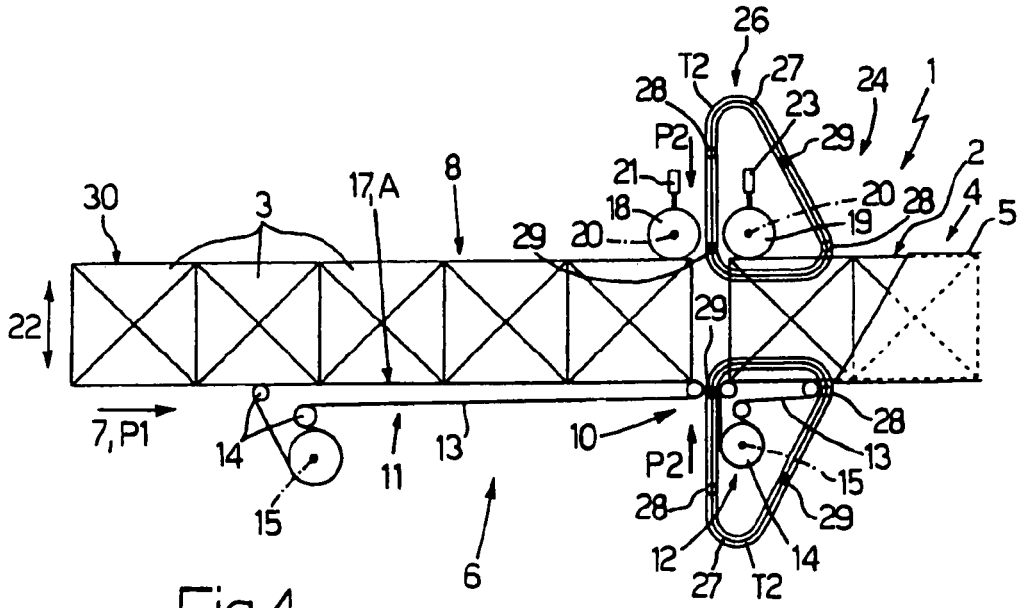

According to what is illustrated in FIGS. 2, 3, and 4, once the rows 30 have been aligned in the direction 16, the following operations are performed: the conveyor 11 and the rods 28 considered are fed in the direction 7 at the same speed as the conveyor 12 and, hence, as the aforesaid tubular casing (not illustrated); the rollers 18 and 19 are displaced in their lowered operating positions and co-operate with the conveyors 11 and 12 so as to feed a number of products 3 corresponding to a group 2 downstream of the station 10 in the direction 7 and so as to insert the products 3 arranged at the front in the direction 7 itself into the forming device 5; and the conveyors 25, 26 are in the first place accelerated so as to disengage the rods 28 considered from the rows 30 and from the portion T1 of the path P2 and are then stopped in such a way that all the rods 28, 29 are arranged along the portion T2 and, consequently, on the outside of the path P1.

Figure 5:
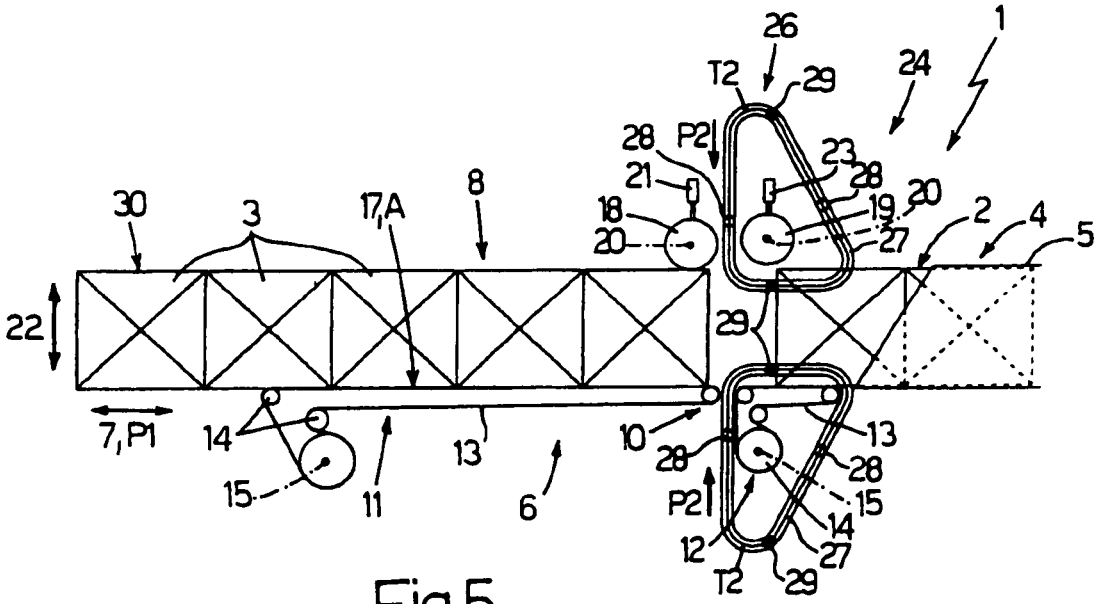

At this point, the conveyor 11 and the roller 18 are stopped to enable the conveyor 12 and the roller 19 to separate the group 2 just formed from the rows 30 (FIG. 4), and the conveyors 25, 26 are actuated again so as to accelerate a pair of thrust rods 29 along the stretch T1 and in contact with the group 2 itself (FIG. 5).

Figure 6:
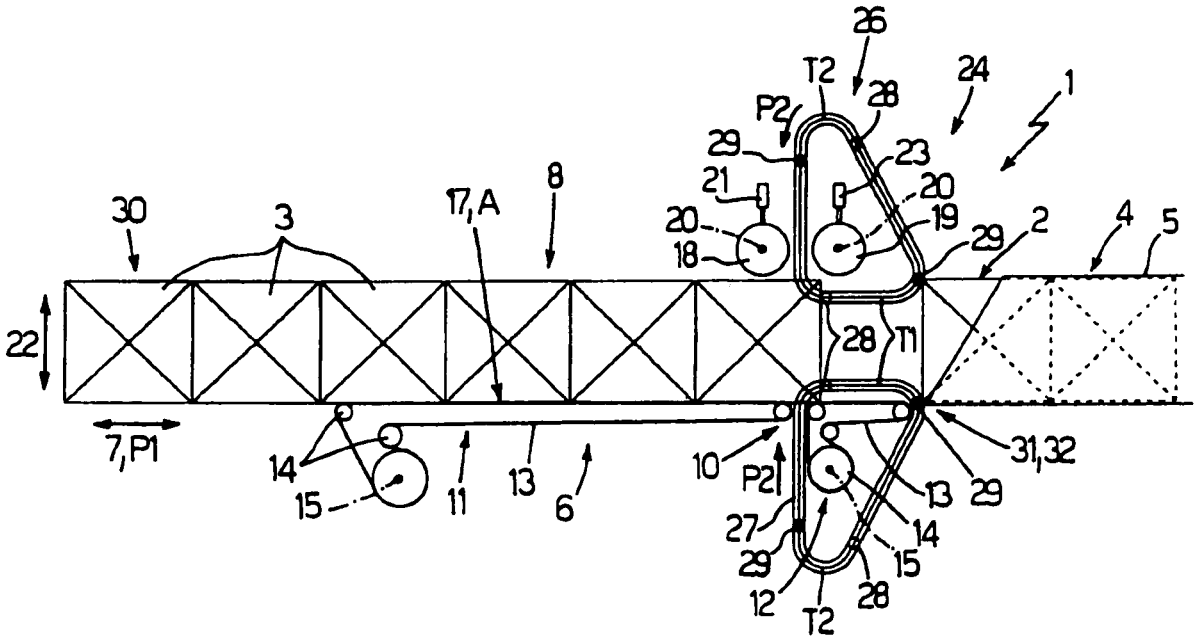

With reference to FIGS. 5 and 6, once the rods 29 have been set in contact with the group 2, they are fed at the same rate as that of the conveyor device 9 and, hence, of the aforesaid tubular casing (not illustrated) and co-operate with the conveyor device 9 itself for feeding the group 2 within the forming device 5, whilst the roller 19 is displaced into its raised resting position.

In this regard, it should be pointed out that the paths P2 are shaped in such a way that the corresponding portions T1 will have respective output ends 31 arranged substantially in a position corresponding to one input end 32 of the device 5 to enable the thrust rods 29 to disengage the group 2 only when all the corresponding products 3 have been completely fed through the end 32 itself.

Finally, according to what is illustrated in FIG. 6, the speed of the conveyors 25 and 26 is selectively controlled to feed a new pair of rods 28 on the inside of the path P1 and the rods 29 considered on the outside of the path P1 itself, the roller 18 is displaced into its raised resting position, the conveyor 11 is again actuated for displacing the rows 30 in contact with the new rods 28, and the operating sequence described above is repeated for the formation of a new group 2 of products 3.

What is claimed is:

1. A method for the formation of groups (2) of products (3) in a machine for continuous packaging of products (3), the method comprising the steps of:

feeding a first plurality of products (3) ordered in at least two continuous rows (30) set alongside one another via first and second conveyor means (8, 9), which are set in series with respect to one another, are connected together in a position corresponding to a transfer station (10) arranged between the first and second conveyor means, and are designed to feed said at least two continuous rows (30) along a first path (P1) and in a first direction (7), the two continuous rows (30) having the first plurality of products extending in the first direction (7);

providing at least one alignment element (28) independent of the first and second conveyor means (8,9), the at least one alignment element (28) configured to extend transversely to said first path (P1) and across said at least two rows of products, which is displaceable along a first loop-like path (P2) comprising: (i) a first portion (T1), wherein the alignment element (28) is set inside the first path (P1) and extends across the at least two rows of products and moves along said first path (P1) in said first direction (7) away from said transfer station, and (ii) a second portion (T2) outside the first path (P 1);

providing at least one thrust element (29) configured to extend transversely to said first path (P1) and across said at least two rows of products, which is displaceable along a second loop-like path (P2) comprising: (i) a first portion (T1), wherein the thrust element (29) is set inside the first path (P1) and extends across the at least two rows of products and moves along said first path (P1) in said first direction (7) away from said transfer station, and (ii) a second portion (T2) outside the first path (P 1);

aligning the rows (30) transversely to said first direction (7) by abutting said at least two rows (30) against said at least one alignment element (28) arranged in front of the rows (30), while moving said alignment element (28) along said first portion (T1) of said first loop-like path (P2) away from said transfer station;

disengaging the alignment element (28) from the first path (P 1);

feeding a second plurality of products (3) from the first plurality that defines a corresponding group (2) of products (3) through said transfer station (10), said group of products including at least two rows of products set alongside in a direction extending transversely to said first direction (7) and with each row including at least two products extending in the first direction;

stopping the first conveyor means (8) for separating the group (2) of products (3) from the continuous rows (30) of products positioned on the first conveyor means (8);

inserting and accelerating said at least one thrust element (29) in said first portion (T1) of said second loop-like path (P2), in contact with and behind said group (2) of products (3) with respect to said first direction (7);

moving said thrust element away from said transfer station along said first direction; and feeding said group (2) of products (3) into a tubular casing made of wrapping material by means of said at least one thrust element (29).

2. The method according to claim 1, wherein said first loop-like path (P2) and said second loop-like path (P2) are identical.

3. The method according to claim 1, further comprising the step of disengaging the thrust element (29) from each group (2) of products (3) when the entire group (2) is set within at least part of said tubular casing.

4. The method according to claim 1, further comprising the step of disengaging the thrust element (29) from each group (2) of products (3) when the alignment element (28) is engaged by said rows (30).

5. The method according to claim 1, further comprising the step of imparting on said first and second conveyor means (8, 9) respective laws of motion independent of one another; the law of motion of said second conveyor means (9) being substantially equal to a law of motion of displacement of said tubular casing.

6. The method according to claim 1, further comprising the step of moving the thrust element (29), when this is set in engagement of a group (2) of products (3), at a speed substantially equal to the speed of the tubular casing.

7. The method according to claim 1, further comprising the step of displacing the alignment element (28) along part of said first portion (T1) at a speed slower than the speed of the first conveyor means (8) to enable the rows (30) to engage the alignment element (28).

8. The method according to claim 1, in which said first and second conveyor means (8, 9) comprise a first conveyor device (11) and a second conveyor device (12), respectively, set in series with respect to one another to define a resting surface (A) for the products (3), and a third conveyor device (18) and a fourth conveyor device (19), respectively, which are designed to engage the products (3) on the side opposite to said first and second conveyor devices (11, 12); the method comprising the step of displacing and maintaining the third and fourth conveyor devices (18, 19) in a resting position of disengagement of the products (3) when the rows (30) come into contact with said alignment element (28).

9. The method according to claim 8, further comprising the step of displacing and maintaining the fourth conveyor device (19) in an operating position of engagement of each group (2) of products (3) during at least part of the step of insertion of the group (2) into said tubular casing.

10. The method according to claim 9 and comprising the step of displacing the fourth conveyor device (19) from its operating position into its resting position when the thrust element (29) comes into contact with a group (2) of products (3).

11. A unit for the formation of groups (2) of products (3) in a machine for continuous packaging of products (3), the unit comprising:

first and second conveyor means (8, 9), which are set in series with respect to one another, are connected together in a position corresponding to a transfer station (10) arranged between the first and second conveyor means, and are designed to feed a plurality of products (3) ordered in at least two continuous rows (30) set alongside one another along a first path (P1) and in a first direction (7), with the two continuous rows (30) having the plurality of products extending in the first direction (7);

at least one alignment element (28) independent of the first and second conveyor means (8, 9), the at least one alignment element (28) configured to be set transverse to the first path (P1) across the at least two rows of products, the at least one alignment element configured and dimensioned to engage the rows (30) at the front with respect to the first direction (7) for aligning the rows (30) in a second direction (16) transverse to the first direction (7); wherein a first actuator means (25, 26) is provided, for displacing the alignment element (28) along a first loop-like path (P2) comprising: (i) a first portion (T1), wherein the alignment element (28) is set inside the first path (P1) and extends across the at least two rows of products and moves along the first path (P1) in said first direction (7) away from said transfer station, and (ii) a second portion (T2) outside the first path (P1);

at least one thrust element (29), which is configured to be set transverse to the first path (P1) across the at least two rows of products, said at least one thrust element (29) being displaceable along a second loop-like path (P2) comprising: (i) a first portion (T1), wherein the thrust element (29) is set inside the first path (P1) and extends across the at least two rows of products and moves along said first path (P1) in said first direction (7) away from said transfer station, and (ii) a second portion (T2) outside the first path (P1);

wherein said first conveyor unit (8) is controlled to stop for separating a group (2) of products (3) from said continuous rows (30) of products; and said at least one thrust element (29) is controlled to be inserted behind said group (2) of products (3) separated from said rows (30), to engage each group (2) of products (3) at the rear with respect to said first direction (7);

wherein each group (2) of products includes at least two rows of products set alongside in a direction extending transversely to the first direction, with each row including at least two products extending in the first direction; and wherein said thrust element (29) is arranged and controlled to move along said first path (P1) in said first direction (7) away from said transfer station, thereby pushing said group (2) of products (3) into a downwardly arranged tubular casing made of wrapping material.

12. The unit according to claim 11 and further comprising logic control means for selectively controlling the speed of said first and second conveyor means (8, 9) so as to separate in succession the groups (2) of products (3) from the rows (30).

13. The unit according to claim 11, wherein said first loop-like path (P2) and said second loop-like path (P2) coincide substantially with one another.

14. The unit according to claim 11, wherein said alignment element (28) and said thrust element (29) are mounted on and moved by a common conveyor (25; 26).

15. The unit according to claim 11, wherein said first portion (T1) has an output end (31) set along the first path (P1) substantially in a position corresponding to an input end (32) of said tubular casing.

16. The unit according to claim 11, wherein the first portion (T1) of the first loop-like path (P2) and the first portion (T1) of the second loop-like path (P2) extend along said second conveyor means (9).

17. The unit according to claim 14, wherein said common conveyor includes at least one flexible conveyor member.

18. The unit according to claim 11, in which said first and second conveyor means (8, 9) comprise a first conveyor device (11) and a second conveyor device (12), respectively, set in series with respect to one another to define a resting surface (A) for the products (3), and a third conveyor device (18) and a fourth conveyor device (19), respectively, which are designed to engage the products (3) on the side opposite to said first and second conveyor devices (8, 9).

19. The unit according to claim 18 and further comprising third actuator means (21) for displacing the third conveyor device (18) between a first resting position of disengagement of the products (3) and a first operating position of engagement of the products (3), and fourth actuator means (23) for displacing the fourth conveyor device (19) between a second resting position of disengagement of the products (3) and a second operating position of engagement of the products (3).

20. The method according to claim 1, wherein said alignment element (28) and said thrust element (29) are mounted on and moved by a common conveyor (25; 26).

21. The method according to claim 20, wherein said common conveyor (25, 26) includes at least one endless conveyor member.

22. The method according to claim 20, wherein said common conveyor (25; 26) is accelerated to disengage the alignment element (28) from the first path (P1) and then stopped in such a way that all the alignment element(s) and thrust element(s) are arranged outside said first path (P1).

23. The unit according to claim 14, wherein said common conveyor (25; 26) is accelerated to disengage the alignment element (28) from the first path (P1) and then stopped in such a way that all the alignment element(s) and thrust element(s) are arranged outside said first path (P1).

24. A method for forming groups (2) of products (3) in a machine for continuous packaging of products (3), the method comprising the steps of:

arranging a first and a second conveyor (8, 9) to feed at least two continuous rows (30) of products (3), set alongside one another, along a product advancement path (P1) in an advancement direction (7), with the at least two continuous rows (30) having a plurality of products extending in the advancement direction (7);

bringing a leading product of each of said rows (30) in abutment against an alignment element (28) extending transversely to said advancement path and across said at least two continuous rows (30), the alignment element (28) being independent of the first and second conveyors (8, 9);

moving said alignment element (28) and said rows (30) of products (3) along said advancement path (P1);

moving the alignment element (28) outside said advancement path (P1);

advancing the plurality of products (3) along said advancement path (P1);

in each row (30), separating a trailing product (3) of a first group (2) from a leading product (3) of a subsequent second group (2), thereby forming a gap between the trailing products of said first group and the leading products of said subsequent second group;

inserting in said gap and in said advancement path (P1) a thrust element (29) between said trailing products (3) of said first group (2) and said leading products (3) of the subsequent second group (2) said thrust element extending transversely substantially across the advancement path of the trailing and leading products;

accelerating said thrust element (29) towards and against said trailing products (3);

pushing said first group (2) of products (3) by means of said thrust element (29) along said advancement path (P1);

feeding said groups (2) of products (3) into a tubular casing made of wrapping material, wherein said groups (2) of products (3) are pushed into said tubular casing by said thrust element (29);

wherein each group (2) of products includes at least two rows of products set alongside in a direction extending transversely to the advancement direction, with each row including at least two products extending in the advancement direction.

25. The method according to claim 24, wherein said alignment element (28) is displaced along a first loop-like path (P2) comprising a first portion (T1), wherein the alignment element (28) is moved along said advancement path (P1) in said advancement direction (7), and a second portion (T2) outside the advancement path (P1).

26. The method according to claim 24, wherein said thrust element (29) is displaced along a second loop-like path (P2) comprising a first portion (T1), wherein the thrust element (29) is moved along said advancement path (P1) in said advancement direction (7), and a second portion (T2) outside the advancement path (P1).

27. The method according to claim 25, wherein said thrust element (29) is displaced along a second loop-like path (P2) comprising a first portion (T1), wherein the thrust element (28) is moved along said advancement path (P1) in said advancement direction (7), and a second portion (T2) outside the advancement path (P1).

28. The method according to claim 27, wherein said first loop-like path (P2) and said second loop-like path (P2) are substantially identical.

29. The method according to claim 27, wherein said alignment element and said thrust element (29) are supported and moved along said first and second loop-like path (P2) by a flexible endless conveyor.

30. The method according to claim 24, further comprising the steps of:

separating said trailing products (3) from said leading products (3) by stopping said first conveyor.

31. A unit for forming groups (2) of products (3) in a machine for continuous packaging of products (3), including:

a product advancement path (P1);

a conveyor arrangement (8, 9), extending along said advancement path (P1), for advancing at least two continuous rows (30) of said products (3) in an advancement direction (7) along said advancement path (P1), said at least two continuous rows (30) being set alongside one another in a direction extending transversely to said advancement direction (7), the products of each row extending in the direction (7);

at least one alignment element (28) independent of the conveyor arrangement (8, 9), the at least one alignment element (28) configured to extend transversely to said product advancement path (P1) and across said at least two rows (30), and movable along a first loop-like path (P2), said first loop-like path (P2) including: (i) a first portion (T1), wherein the alignment element (28) is set inside the advancement path (P1) and extends across the at least two rows and moves along said advancement path (P1) in said advancement direction, and (ii) a second portion (T2) extending outside the advancement path (P1);

at least one thrust element (29) configured to extend transversely to said product advancement path (P1) and across said at least two rows (30), and movable along a second loop-like path (P2), said second loop-like path including: (i) a first portion (T1), wherein the thrust element (29) is set inside the advancement path (P1) and extends across the at least two rows and moves along said advancement path (P1) in said advancement direction, and (ii) a second portion (T2) extending outside the advancement path (P1);

wherein said at least one thrust element (29) is controlled to be inserted and accelerated between a first group (2) of products (3) and a subsequent group of products (3) and to push said groups of products into a tubular casing made of wrapping material;

wherein each group (2) of products includes at least two rows of products set alongside in a direction extending transversely to the advancement direction, with each row including at least two products extending in the advancement direction.

32. The unit according to claim 31, wherein said alignment element (28) and said conveyor arrangement are arranged and controlled such that a group (2) of products (3) advancing along said advancement path (P1) is caused to abut against said alignment element (28), said alignment element (28) advancing along a portion of said advancement path (P1) along with said group (2) of products (3).

33. The unit according to claim 32, wherein said thrust element (29) and said conveyor arrangement are arranged and controlled such that said group (2) of products (3) is pushed by said thrust element (29) along a portion of said advancement path (P1).

34. The unit according to claim 31, wherein said conveyor arrangement (8, 9) is controlled to separate in each row a trailing product of a first group (2) of products (3) from a leading product (3) of a subsequent group (2) of products (3), said thrust element (29) being arranged and controlled to be moved into said advancement path (P1) behind and against said trailing products (2).

35. The unit according to claim 31, wherein said advancement path (P1) is substantially horizontal and said first and second loop-like paths (P2) extend above said advancement path (P1).

36. The unit according to claim 31, wherein said advancement path (P1) is substantially horizontal and said first and second loop-like paths (P2) extend below said advancement path (P1).

37. The unit according to claim 31, further comprising:

a third loop-like path;

at least one further alignment element (28) movable along said third loop-like path; said third loop-like path including a first portion (T1), in which the respective alignment element is set inside the advancement path (P1) and moves there along; and a second portion (T2) outside the advancement path (P1);

a fourth loop-like path; and at least one further thrust element movable along said fourth loop-like path; said fourth loop-like path including a first portion (T1), in which the respective thrust element is set inside the advancement path (P1) and moves there along; and a second portion (T2) outside the advancement path (P1).

38. The unit according to claim 37, wherein said first and second loop-like paths extend above said advancement path (P1) and said third and fourth loop-like paths extend underneath said advancement path (P1).

39. The unit according to claim 34, wherein said conveyor arrangement (8, 9) includes a first conveyor (8) and a second conveyor (9), said first and second (8, 9) conveyors being arranged in series along said advancement path (P1); and wherein said first conveyor (8) is controlled to stop to separate said trailing products (3) of said first group (2) of products (3) from the leading products (3) of the subsequent group (2).

40. The unit according to claim 31, wherein said alignment element (28) and said thrust element (29) extend across the entire width of said at least two rows (30) of products.

41. The unit according to claim 31, wherein said first loop-like path (P2) and said second loop-like path (P2) coincide substantially with one another.

42. The unit according to claim 31, wherein said alignment element (28) and said thrust element (29) are mounted on and moved by a common conveyor (25; 26).

43. The unit according to claim 42, wherein said common conveyor includes at least one flexible conveyor member.

44. The unit according to claim 37, wherein said third loop-like path (P2) and said fourth loop-like path (P2) coincide substantially with one another.

45. The unit according to claim 37, wherein said further alignment element (28) and said further thrust element (29) are mounted on and moved by a common conveyor (25; 26).

46. The unit according to claim 40, wherein said common conveyor includes at least one flexible conveyor member.

* * * * *